US009280093B2

(12) United States Patent
Yokoyama et al.

(10) Patent No.: US 9,280,093 B2
(45) Date of Patent: Mar. 8, 2016

(54) DEVELOPING AGENT CARTRIDGE AND IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Noriyuki Yokoyama, Shizuoka (JP); Takafumi Amano, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/596,365

(22) Filed: Jan. 14, 2015

(65) Prior Publication Data

US 2015/0205227 A1 Jul. 23, 2015

(51) Int. Cl.
*G03G 15/08* (2006.01)

(52) U.S. Cl.
CPC ..... *G03G 15/0891* (2013.01); *G03G 15/0867* (2013.01); *G03G 15/0881* (2013.01)

(58) Field of Classification Search
CPC ..... G03G 15/0832; G03G 15/0834; G03G 15/0841; G03G 15/0882; G03G 2215/0687
See application file for complete search history.

(56) References Cited

U.S. PATENT DOCUMENTS

| | | | | |
|---|---|---|---|---|
| 4,615,608 | A * | 10/1986 | Mizutani | 399/103 |
| 5,598,254 | A | 1/1997 | Ikesue et al. | |
| 6,463,242 | B1 * | 10/2002 | Kojima et al. | 399/258 |
| 6,516,168 | B2 * | 2/2003 | Shiratori et al. | 399/103 |
| 6,880,924 | B2 * | 4/2005 | Sesek et al. | 347/86 |

* cited by examiner

*Primary Examiner* — Gregory H Curran
(74) *Attorney, Agent, or Firm* — Amin, Turocy & Watson, LLP

(57) ABSTRACT

In accordance with an embodiment, a developing agent cartridge for supplying developing agent and toner to a developing device comprises a cartridge main body, in which there is a first room and a second room and the boundary of the two rooms is closed by a closure member, configured to respectively fill the toner and the developing agent into the first room and the second room; a supply section configured to supply the infill in the second room to the developing device while stirring it; and an opening section configured to open the closure member to enable the toner to be moved to the second room after the developing agent filled into the second room is supplied to the developing device.

4 Claims, 5 Drawing Sheets

DEVELOPING AGENT CARTRIDGE AND IMAGE FORMING APPARATUS

CROSS-REFERENCE TO RELATED APPLICATION

This application is based upon and claims the benefit of priority from Japanese Patent Application No. 2013-006606, filed Jan. 17, 2014, the entire contents of which are incorporated herein by reference.

FIELD

Embodiments described herein relate generally to a developing agent cartridge for supplying developing agent to a developing device, and an image forming apparatus for forming an image on an image receiving medium using the developing device.

BACKGROUND

Generally, in an electrophotographic recording type image forming apparatus, a photoconductive drum is irradiated with laser beam to form an electrostatic latent image. The photoconductive drum forms a toner image with the toner supplied from a developing device, and transfers the toner image to a paper to form an image. In the developing device, when the toner in the developing device is insufficient, toner is replenished from a toner replenishing port of the developing device. Further, at time of shipment, setting, maintenance and the like, the serviceman fills the two-component developing agent including toner and carrier through a developing agent filling port into the empty developing agent housing section.

Further, when the two-component developing agent is used repeatedly, the carrier of the two-component developing agent is gradually deteriorated and the developing capability is reduced, thus the developing agent including the deteriorated carrier is exchanged by the serviceman. Conventionally, when inputting the developing agent to the developing device, the following work is needed, that is, a process unit is taken out from the main body, the lid of the developing device is opened to input the developing agent, and then the process unit is installed in the main body again. Further, for facilitating the work, there is a mechanism in which the developing agent is automatically input to the developing device from a cartridge by sealing the developing agent in the cartridge and setting the cartridge in the main body of the image forming apparatus.

However, in the above-mentioned mechanism, in addition to the toner cartridge, a developing agent cartridge needs to be installed in the main body, and thus, there is a problem that additional space is required. Further, in the example disclosed in Japanese Unexamined Patent Application Publication No. Hei 8-185033, that the developing agent container and the toner container are set to one container is disclosed.

The example disclosed in Japanese Unexamined Patent Application Publication No. Hei 8-185033 is only applicable to the apparatus having a mechanism in which the whole toner container rotates. Further, at time of shipment, setting, and maintenance, the toner concentration is adjusted to be a given ratio when replenishing the developing agent; however, since the toner container is not sealed, there is a possibility that some toner is replenished. Thus, the toner concentration (TC) within the two-component developing agent is changed, which affects the gradation reproducibility, and results in an image failure.

DETAILED DESCRIPTION

Figure 1:
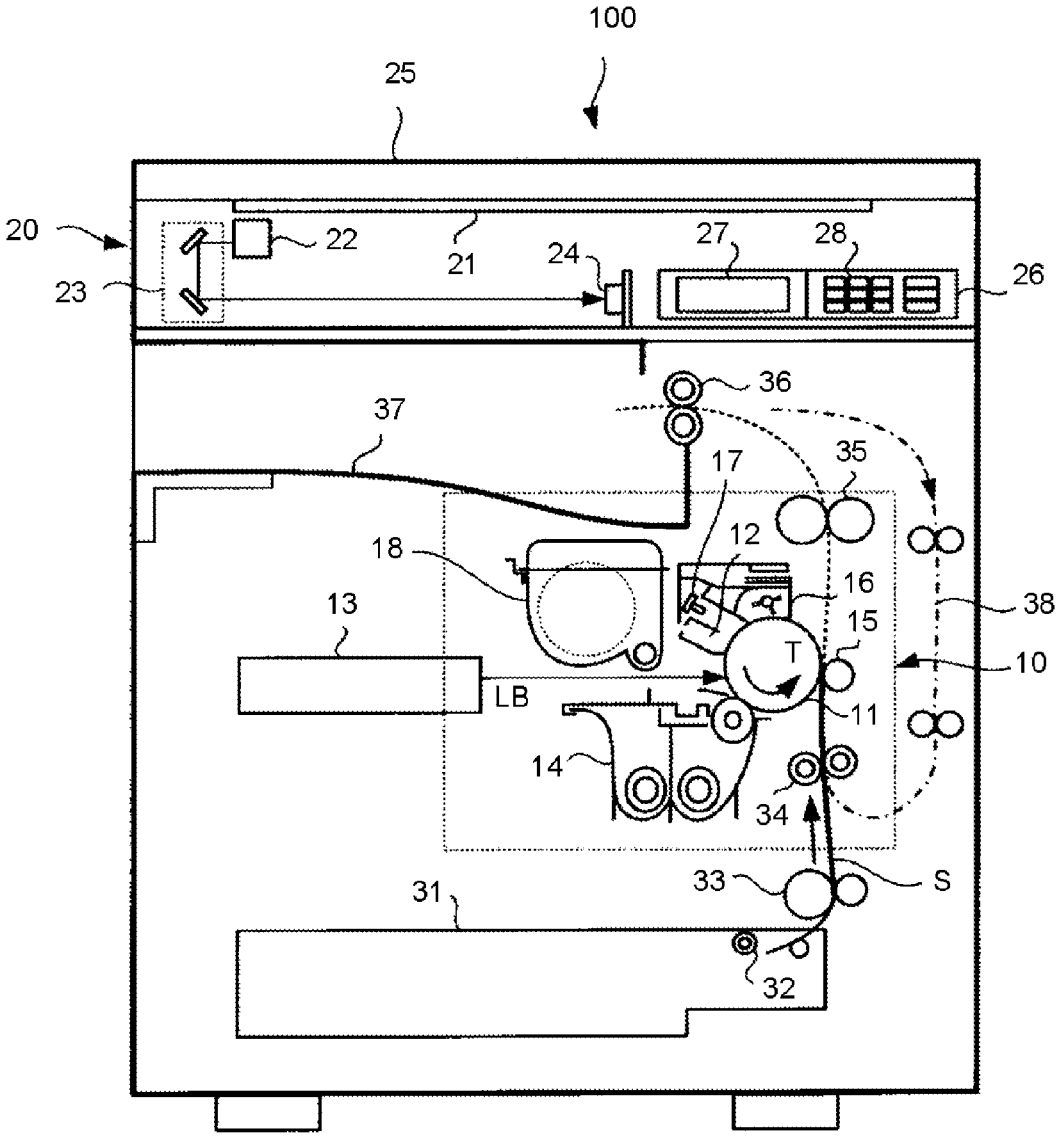
FIG. 1 is a constitution diagram illustrating an image forming apparatus according to an embodiment.

In accordance with an embodiment, a developing agent cartridge for supplying developing agent and toner to a developing device comprises a cartridge main body, in which there is a first room and a second room and the boundary of the two rooms is closed by a closure member, configured to respectively fill the toner and the developing agent into the first room and the second room; a supply section configured to supply the infill in the second room to the developing device while stirring it; and an opening section configured to open the closure member to enable the toner to be moved to the second room after the developing agent filled into the second room is supplied to the developing device.

Hereinafter, the embodiment for implementing the present invention is described with reference to the accompanying drawings. Further, the same components are applied with the same reference numerals in the drawings, and the description thereof is not provided.

A First Embodiment

FIG. 1 is a constitution diagram of an image forming apparatus according to the embodiment. In FIG. 1, an image forming apparatus 100 is, for example, a copier, a printer, an MFP (multi-function peripheral) and the like. The copier is exemplified in the following description, and the printer, the MFP and the like may also be applicable.

The copier 100 is provided with an image forming section 10 at the center thereof. The image forming section 10 includes a rotatable photoconductive drum 11. The photoconductive drum 11 serving as an image carrier includes a photo conductor at the outer peripheral surface thereof. If the photoconductive drum 11 is irradiated with light in a state of being applied with a given potential, the potential of the area of the photoconductive drum 11 irradiated with the light is changed. The photoconductive drum 11 maintains the change of the potential as an electrostatic latent image for a given time.

An electrostatic charger 12, an exposure unit 13, a developing device 14, a transfer roller 15, a drum cleaner 16 and a charge removing lamp 17 are arranged around the photoconductive drum 11 along a rotation direction T of the photoconductive drum 11.

The electrostatic charger 12 charges the surface of the photoconductive drum 11 to a given potential. The exposure unit 13 irradiates the photoconductive drum 11 with a laser beam LB to expose the photoconductive drum 11. Through the exposure processing, an electrostatic latent image is formed on the surface of the photoconductive drum 11. The light intensity of the laser beam LB varies according to image density and the like.

The developing device 14 stores two-component developing agent including toner and carrier. The developing device 14 supplies developing agent to the surface of the photoconductive drum 11 to develop the electrostatic latent image on the photoconductive drum 11. The electrostatic latent image on the surface of the photoconductive drum 11 is visualized to form a toner image. The transfer roller 15 applies a given potential to a paper S, and transfers the toner image on the photoconductive drum 11 to the paper S. The drum cleaner 16 removes and collects the toner left on the surface of the photoconductive drum 11. The charge removing lamp 17 removes the charge left on the photoconductive drum 11.

Further, a developing agent cartridge 18 for housing toner and developing agent is arranged above the developing device 14. After the toner and the developing agent in the developing device 14 are consumed, the toner and the developing agent are replenished from the developing agent cartridge 18 to the developing device 14. The developing agent cartridge 18 is exchangeable, and is hereinafter referred to as a cartridge simply.

Further, a scanner 20 is arranged at the upper portion of the copier 100. The scanner 20 reads the documents placed on a document placing table 21. The scanner 20 includes a light source 22, a reflecting mirror 23 and a light receiving element 24. The light source 22 irradiates the document placed on the document placing table 21 with light. The reflecting mirror 23 reflects the light reflected from the document. The light receiving element 24 receives the light reflected from the reflecting mirror 23. Further, a cover 25 and an operation panel 26 are arranged at the upper portion of the document placing table 21. The operation panel 26 includes a touch panel type display section 27 and an operation section 28.

A paper feed cassette 31 is arranged at the lower portion of the copier 100. A plurality of paper feed cassettes may be arranged according to the paper size. The paper S (image receiving medium) in the paper feed cassette 31 is conveyed upward through a pickup roller 32, an aligning roller 33 and a conveyance roller 34, and then is discharged to a paper discharge tray 37 through a fixing roller 35 and a paper discharge roller 36.

The pickup roller 32 picks up the paper S in the paper feed cassette 31 one by one, and conveys the paper S to the aligning roller 33. The aligning roller 33 rotates at given timing to convey the paper S to the transfer position so as to align the positions of the paper S and the toner image formed on the photoconductive drum 11.

The fixing roller 35 heats and presses the paper S to which the toner image is transferred by the transfer roller 15, and fixes the toner image on the paper S. The paper discharge roller 36 conveys the paper S discharged from the fixing roller 35 to the paper discharge tray 37.

When forming an image, the document on the document placing table 21 is irradiated with the light from the light source 22. The light reflected from the document is reflected by the reflecting mirror 23 to the light receiving element 24, in this way, the document image is read. The laser beam LB is output from the exposure unit 13 based on the information read by the light receiving element 24, or the image information supplied from an external device such as a PC (Personal Computer) and the like. The surface of the photoconductive drum 11 is irradiated with the laser beam LB. The surface of the photoconductive drum 11 is charged to negative polarity by the electrostatic charger 12. The photoconductive drum 11 is exposed by emitting the laser beam LB from the exposure unit 13. In this way, the electrostatic latent image is formed on the surface of the photoconductive drum 11.

The toner is absorbed by the developing device 14, and thus the electrostatic latent image formed on the photoconductive drum 11 is visualized to be a visible image (toner image). Then, if the paper S picked up from the paper feed cassette 31 is conveyed, the visible image on the photoconductive drum 11 is transferred to the paper S by the transfer roller 15. The paper S to which the image is transferred is conveyed to the fixing roller 35, and heated and pressed by the fixing roller 35, in this way, the image is fixed on the paper S. The paper S on which the image is fixed is discharged to the paper discharge tray 37 through the paper discharge roller 36.

Further, a reversal conveyance path 38 is arranged at the downstream side of the fixing roller 35. The reversal conveyance path 38 is arranged to be used in a case of duplex printing to reverse the paper S and guide the paper S to the transfer roller 15.

Figure 2:
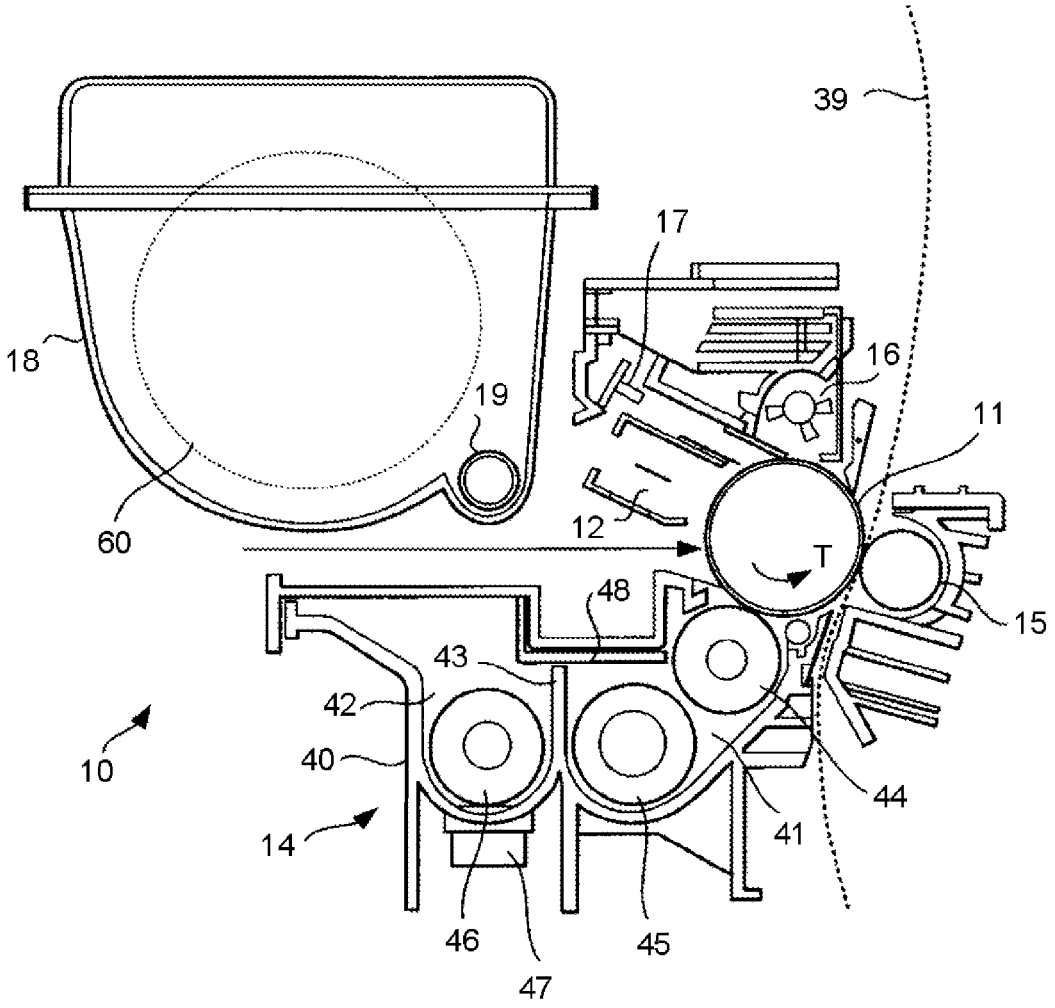
FIG. 2 is an enlarged constitution diagram illustrating an image forming section according to the embodiment.

FIG. 2 is a detailed constitution diagram of the image forming section 10, and is a front view of the developing device 14 when viewed from the nearer side (front side). The dotted line 39 in FIG. 2 indicates the conveyance path of the paper S. As shown in FIG. 2, the cartridge 18 for replenishing the toner and the developing agent to the developing device 14 is arranged above the developing device 14. The toner and the developing agent are supplied from the cartridge 18. The cartridge 18 is provided with a supply section 19 that rotates through a driving device, and supplies the developing agent and the toner to the developing device 14 through the supply section 19. The cartridge 18 is exchanged by the serviceman or the user. The cartridge 18 will be described in detail later.

The developing device 14 comprises a container 40 for housing the two-component developing agent (hereinafter referred to as developing agent) including carrier and toner, and the container 40 is provided with chambers 41 and 42. A partition 43 is arranged to divide the container 40 into the two chambers 41 and 42. In the chamber 41 of the container 40, a first mixer 45 and a developing roller 44 arranged to be opposite to the photoconductive drum 11 are arranged. Around the photoconductive drum 11, the electrostatic charger 12 is arranged at the upstream side of the developing roller 44, and the transfer roller 15, the drum cleaner 16 and the charge removing lamp 17 are sequentially arranged at the downstream side of the developing roller 44.

A second mixer 46 is arranged in the chamber 42 of the container 40, and a magnetic sensor 47 for detecting the concentration of the toner housed in the container 40 is arranged in the chamber 42. It is preferred that the magnetic sensor 47 is arranged at the lower portion of the container 40. Further, a layer regulating blade 48 is arranged for the developing roller 44 so as to regulate the thickness of the developing agent on the surface of the developing roller 44 to be not too thick.

Figure 3:
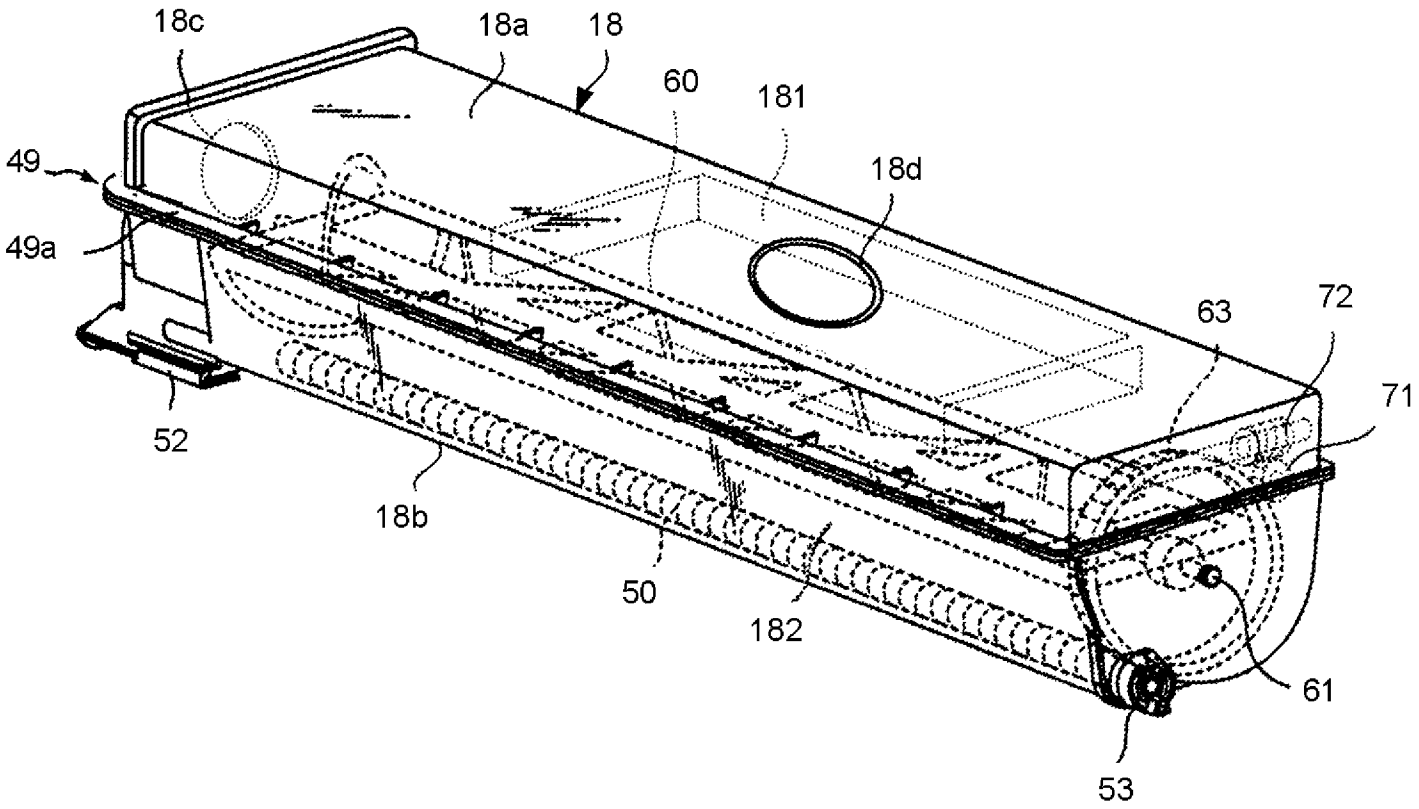
FIG. 3 is a perspective view illustrating a developing agent cartridge according to the embodiment.
Figure 4:
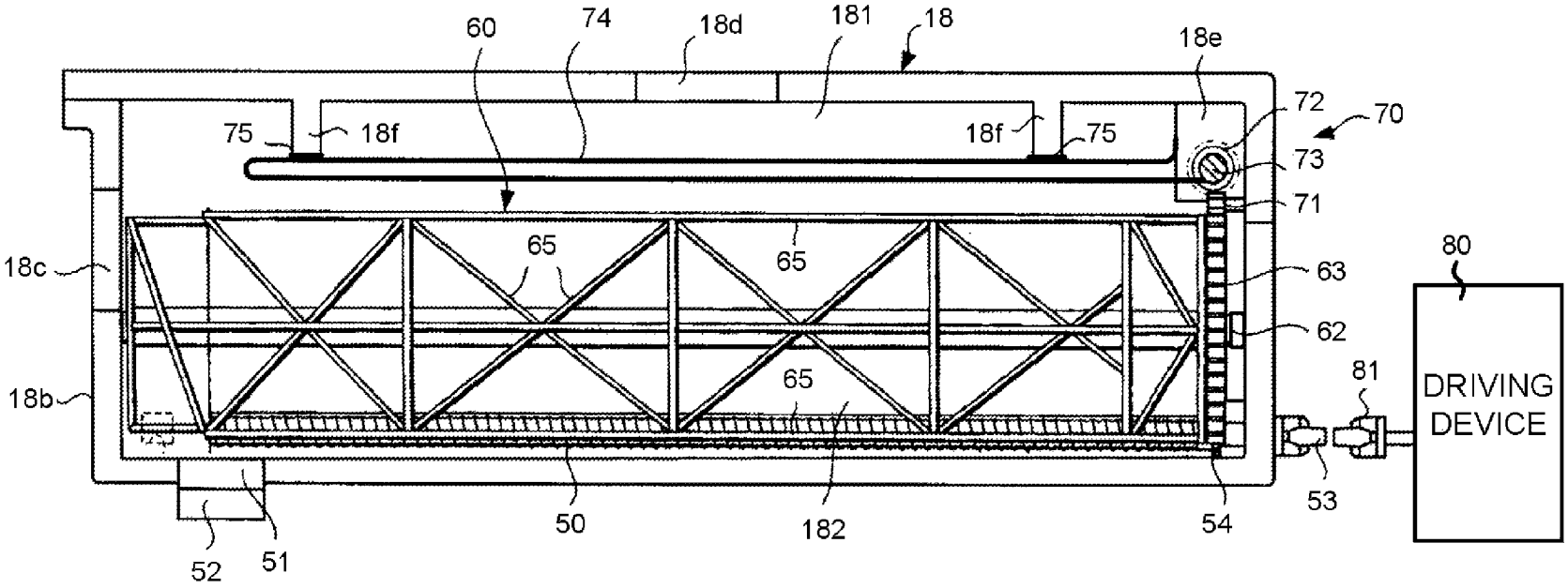
FIG. 4 is a cross-sectional view illustrating the internal constitution of the developing agent cartridge according to the embodiment.

FIG. 3 is a perspective view illustrating the cartridge 18 according to the embodiment when viewed from the internal side of the copier 100, and FIG. 4 is a cross-sectional view illustrating the internal constitution of the cartridge 18.

As shown in FIG. 3 and FIG. 4, the cartridge 18 is molded by a material such as resin, and is provided with a cartridge main body consisting of an upper case 18*a* and a lower case 18*b* that are capable of being divided vertically. The interior of the cartridge main body is constituted by a first room 181 and a second room 182, and the boundary of the first room 181 and the second room 182 is closed by a closure member 74 (later described in FIG. 4), in this way, the first room 181 and the second room 182 are divided from each other by the closure member 74. For facilitating the description, the room 181 is also referred to as a toner room, and the room 182 is also referred to as a developing agent room. In the figures, the developing agent room 182 is arranged below the toner room 181.

A rib 49 for joining the upper case 18*a* and the lower case 18*b* is arranged at the edges of the upper case 18*a* and the lower case 18*b*. The rib 49 is arranged over the whole circumference of the cartridge 18, and serves as a sliding section 49*a* when the cartridge 18 is inserted into and installed in the main body of the copier 100 in a sliding manner.

A discharge port 51 (FIG. 4) which is used for discharging the toner and the developing agent in the cartridge 18 into the developing device 14 is formed on the bottom of the lower case 18*b*. The discharge port 51 protrudes downward from the lower case 18*b*, and a shutter 52 for opening and closing the discharge port 51 is arranged on the protruded end of the discharge port 51 in a movable manner. Further, a rod-shaped screw 50 for conveying the toner and the developing agent in the cartridge 18 to the discharge port 51 is arranged at a position facing the discharge port 51 on the bottom of the lower case 18*b* in the longitudinal direction. The screw 50 constitutes a part of the supply section 19 in FIG. 2. The two ends in the longitudinal direction of the screw 50 are supported by the lower case 18*b* in a rotatable manner.

One end in the longitudinal direction of the screw 50 protrudes outward from the back surface of the lower case 18*b*. A first coupling member 53 connected with a driving device 80 in the main body of the copier 100 is arranged on the front end of the one end in the longitudinal direction of the screw 50. Further, a mixer 60 for stirring the toner and the developing agent in the cartridge 18 is arranged in the longitudinal direction in the cartridge 18. The mixer 60 constitutes the supply section 19 in FIG. 2 together with the screw 50, and supplies the infill (developing agent, toner) in the second room 182 to the developing device 14 while stirring it.

Figure 5:
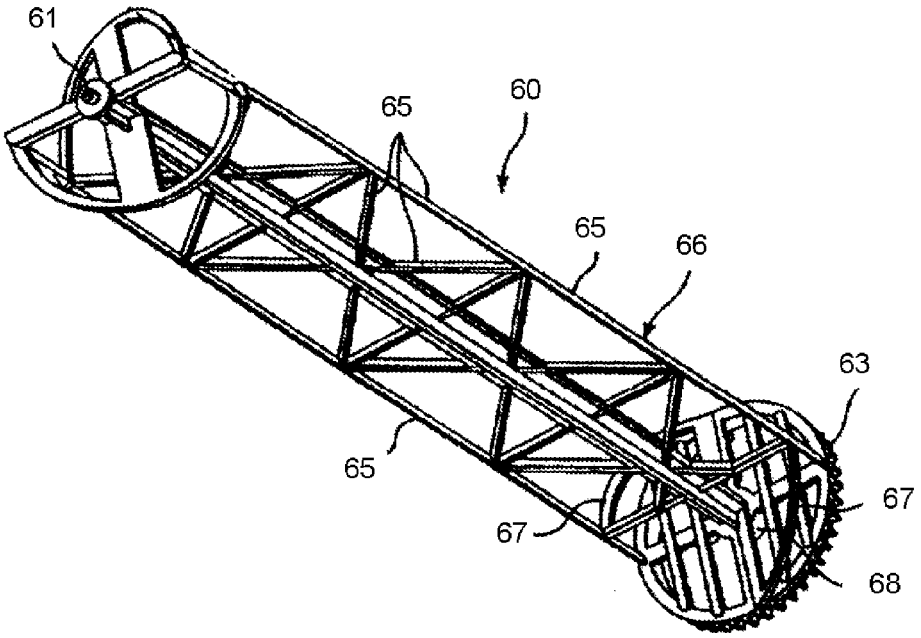
FIG. 5 is a perspective view illustrating a mixer in the developing agent cartridge according to the embodiment.

FIG. 5 is a perspective view of the mixer 60. Hereinafter, the present embodiment is described also with reference to FIG. 5. A shaft member 61 of the mixer 60 is supported by a bearing section 62 (FIG. 4) arranged on the two end surfaces in the longitudinal direction of the lower case 18*b* in a rotatable manner. A mixer gear 63 is arranged on one end in the longitudinal direction of the shaft member 61 of the mixer 60. The mixer gear 63 is meshed with a screw gear 54 arranged on one end in the longitudinal direction of the screw 50, and if the screw 50 rotates, the mixer 60 is interlocked to rotate. Thus, the first coupling member 53, the screw gear 54 and the mixer gear 63 constitute a transmission mechanism for transmitting a rotation force from the driving device 80 to the screw 50 and the mixer 60.

The mixer 60 includes the round-rod shaped shaft member 61, and a plate-like truss structure 66 formed by combining a plurality of thin rod-shaped members 65 on the outer periphery of the shaft member 61. Further, on one end in the longitudinal direction of the mixer 60, a spiral conveyance blade 67 for rapidly removing the toner nearby the meshed part of the mixer gear 63 and the screw gear 54 is arranged. In addition, around the shaft member 61 of the mixer 60, a wall portion 68 is arranged for preventing the toner in the cartridge 18 from entering a space between the shaft member 61 and the bearing section 62.

Further, as shown in FIG. 3 and FIG. 4, a filling port 18*c* for filling the developing agent into the room 182 is formed at a position deviated from the axial line of the mixer 60 on the front surface of the lower case 18*b* of the cartridge 18. The filling port 18*c* is sealed by a cap (not shown). Further, the work of filling the developing agent and the toner into the cartridge 18 is carried out by the manufacture of the cartridge 18.

Further, when the cartridge 18 is inserted into and mounted in the main body of the copier 100, the driving device 80 including a motor for rotating the screw 50 is arranged at a position facing the first coupling member 53 in the main body of the copier 100. The driving device 80 is provided with a second coupling member 81 at a position facing the first coupling member 53. By combining the second coupling member 81 with the first coupling member 53 and driving the driving device 80, it is possible to rotate the first coupling member 53 at a given speed.

As shown in FIG. 3 and FIG. 4, the toner room 181 and the developing agent room 182 are divided vertically, and a filling port 18*d* for filling the toner is arranged on the upper case 18*a*. The filling port 18*d* can be closed with a cap.

Figure 6:
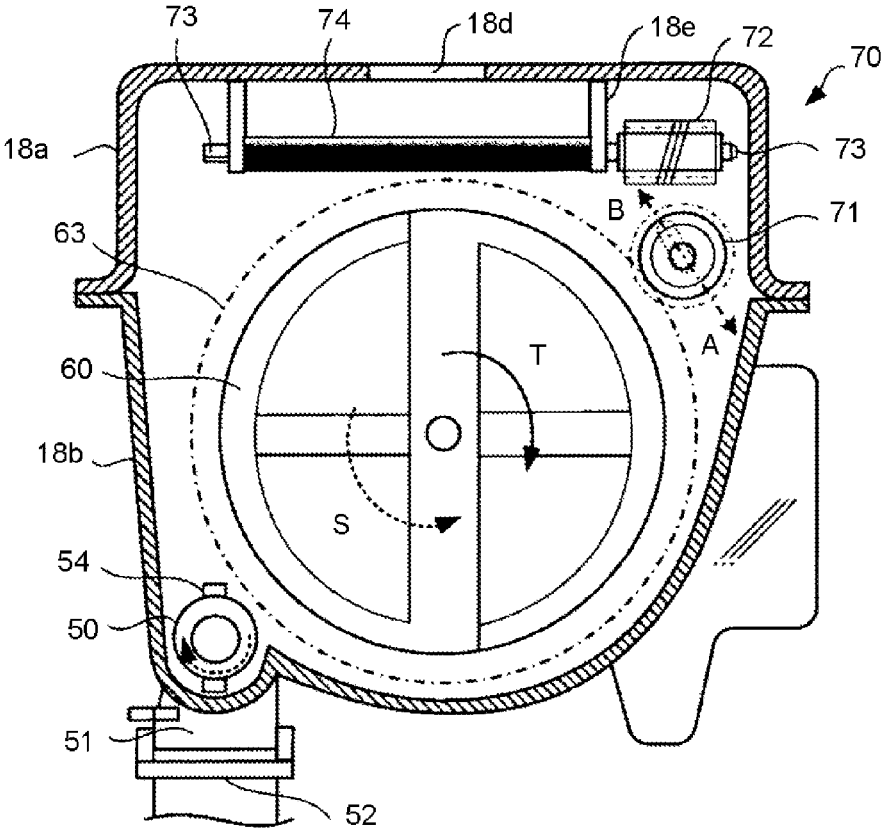
FIG. 6 is a cross-sectional view illustrating the constitution of an opening section of the developing agent cartridge when viewed from the back according to the embodiment.

Further, an opening section 70 shown in FIG. 6 is arranged on the end of the upper case 18*a* where the mixer gear 63 is positioned. The opening section 70 is provided with a gear 71 capable of rotating with being meshed with the mixer gear 63, and a worm gear 72. The gear 71 can move only a specific distance in the rotation direction of the mixer gear 63. Further, the worm gear 72 is mounted nearby the gear 71. A shaft 73 of the worm gear 72 is orthogonal to the shaft member 61 of the mixer 60.

If the mixer gear 63 rotates clockwise (T), the gear 71 is separated from the worm gear 72. Further, if the mixer gear 63 rotates anticlockwise (S), the gear 71 is meshed with the worm gear 72, and the rotation of the mixer gear 63 is transmitted to the worm gear 72 through the gear 71, and in this way, the shaft 73 is rotated. The shaft 73 is supported by a supporting section 18*e* arranged in the upper case 18*a*.

Further, as shown in FIG. 4, a seal member 74 is mounted on the bottom of the toner room 181. The seal member 74 is the closure member for blocking the bottom of the toner room 181, that is, the boundary of the first room 181 and the second room 182. As shown in FIG. 4, the seal member 74 is bent in a U-shape, and one end of the seal member 74 is fixed on the shaft 73 of the worm gear 72, and the other end is fixed by the supporting section 18*e*. Further, the upper surface of the seal member 74 is fixed by an adhesive 75 and the like on the end of a supporting section 18*f* of the toner room 181. The adhesive 75 may be peeled off if the seal member 74 is pulled with a given force.

Thus, when the worm gear 72 rotates, the seal member 74 is wound around the shaft 73, the adhesive 75 is peeled off if the winding of the seal member 74 is continued, and at last the seal member 74 is wholly wound around the shaft 73. Hereinafter, the shaft 73 is referred to as a winding shaft. The worm gear 72 constitutes a winding mechanism for opening the boundary of the first room 181 and the second room 182 by winding the seal member 74.

If the seal member 74 is wholly wound around the winding shaft 73, the bottom of the toner room 181 is opened, and the toner falls into the room 182 and is stirred by the mixer 60. That is, when the developing agent filled into the second room 182 is supplied to the developing device 14, the opening section 70 opens the seal member 74 serving as the closure member so that the toner is moved from the first room 181 to the second room 182.

In the present embodiment, the developing agent (two-component developing agent including carrier and toner) is filled from the filling port 18*c* into the room 182 of the cartridge 18, and the toner is filled from the filling port 18*d* into the room 181. During the filling operation, the space between the room 181 and the room 182 is closed by the seal member 74 in order not to mix the toner and the developing agent. In a state in which the room 181 and the room 182 are divided, if the cartridge 18 is inserted into the main body of the copier 100, first, the screw 50 is rotated by the driving device 80 in a first direction (this rotation is referred to as forward rotation).

Referring to FIG. 6, if the screw 50 is rotated forward, the mixer gear 63 is rotated in a T direction through the rotation of the screw gear 54, and the mixer 60 is also interlocked to rotate. Further, the gear 71 is moved in a direction indicated by an arrow A when the mixer gear 63 is rotated forward, in this way, the engagement with the worm gear 72 is released, and the worm gear 72 isn't rotated. Thus, the toner room 181 is in a sealed state by the seal member 74, and only the developing agent is stirred by the mixer 60, and is further conveyed towards the discharge port 51 through the rotation of the screw 50. At this time, the shutter 52 is opened, and the developing agent is supplied to the developing device 14 from the discharge port 51.

If the two-component developing agent is supplied to the developing device 14, the toner concentration is adjusted to be a given ratio with, for example, a TC (Toner Concentration) sensor. This adjustment is generally referred to as the ATC (Auto Toner Concentration), and is used to make the ratio of the toner and the carrier moving the toner to the photoconductive drum proper. During this adjustment, since the TC is changed if the toner is supplied from the toner room 181, the toner room 181 is sealed by the seal member 74.

After the developing agent is supplied to the developing device 14, the driving device 80 drives the screw 50 to rotate in a reverse direction (second direction). If the screw 50 is rotated backward, the screw gear 54 is also rotated backward, and the mixer gear 63 is rotated in the S direction. The gear 71 is moved in a direction indicated by an arrow B when the mixer gear 63 is rotated backward, and is meshed with the worm gear 72, and in this way, the rotation of the mixer gear 63 is transmitted to the worm gear 72 through the gear 71, and the worm gear 72 is rotated. As a result, the seal member 74 is wound around the winding shaft 73 of the worm gear 72, the toner room 181 is opened and the toner falls into the room 182.

When the toner falls into the room 182, the driving device 80 drives the coupling member 53 to be in a forward rotation state again to rotate the screw 50 and the screw gear 54 forward, and the mixer gear 63 is rotated in the T direction. Thus, the mixer 60 is also interlocked to rotate forward, and the gear 71 is moved in the direction indicated by the arrow A when the mixer gear 63 is rotated forward. As a result, the engagement with the worm gear 72 is released, and the rotation of the worm gear 72 is stopped. At this moment, the seal member 74 is wholly wound around the winding shaft 73. The toner fallen into the room 182 is stirred by the mixer 60 and is further conveyed towards the discharge port 51 through the rotation of the screw 50, and the toner is supplied to the developing device 14 from the discharge port 51.

Further, after the cartridge 18 is inserted into the main body of the copier 100, the driving device 80 rotates forward initially, and then rotates backward, and the time from the forward rotation to the backward rotation is set to the time taken to supply all developing agent to the developing device 14. That is, the time taken to supply all developing agent to the developing device 14 can be preset on the basis of the amount of the developing agent, the rotation speed of the screw 50 and the like. Further, the driving of the driving device 80 may be automatically started by detecting that the cartridge 18 is inserted into the main body of the copier 100, or started by operating the operation section 28 by the user.

Further, when the supplying of the developing agent to the developing device 14 is completed, the driving device 80 is rotated backward, and then is rotated forward, and the time from the backward rotation to the forward rotation is set to the time required for wholly winding the seal member 74. That is, the time required for wholly winding the seal member 74 can be preset according to the length of the seal member 74, the rotation speed of the winding shaft 73 and the like.

Further, after initially the developing agent is supplied to the developing device 14, it is assumed that some developing agent is remained on the screw 50; however, only a little developing agent is remained, which will not affect the adjustment of the toner concentration. Further, it is preferred that the seal member 74 is formed by somewhat rigid material rather than soft material. That is, since the seal member 74 may droop and tangle the mixer 60 when being formed by too thin and soft material, the seal member 74 may use rigid material as long as it will not droop when winding it.

According to the embodiment described above, since the cartridge 18 is used as the toner container and the developing agent container, and the toner is not supplied when the developing agent is supplied initially, the TC is not changed. In this way, the gradation reproducibility is not affected, thereby preventing the deterioration in performance of the image formation.

Further, it is exemplified in the embodiment described above that the opening section 70 is the structure in which the room 181 is closed by the seal member 74 and then the seal member 74 is wound; however, the opening section 70 may be a structure capable of closing/opening the boundary of the room 181 and the room 182. Further, it is exemplified that the gear 71 and the worm gear 72 of which the shafts are orthogonal to each other are the modules for transmitting the driving force of the driving device 80 to the winding shaft 73; however, the driving force of the driving device 80 may also be transmitted by a spur gear, a crown gear (face gear), a bevel gear and the like, and the constitution of the transmitting module is not limited to the examples shown in the drawings.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A developing agent cartridge for supplying developing agent and toner to a developing device, comprising:

a cartridge main body, in which there is a first room and a second room and the boundary of the two rooms is closed by a closure member, configured to be filled with the toner and the developing agent into the first room and the second room, respectively;

a supply section configured to supply an infill in the second room to the developing device while stirring it; and an opening section configured to open the closure member to enable the toner to be moved to the second room after the developing agent filled into the second room is supplied to the developing device;

wherein the cartridge main body is provided with a toner filling port and a developing agent filling port configured to respectively fill the toner and the developing agent into the first and second rooms that are divided by the closure member.

2. The developing agent cartridge according to claim 1, wherein the closure member consists of a seal member for occluding the boundary of the first room and the second room, and the opening section includes a winding mechanism which winds the seal member to open the boundary.

3. An image forming apparatus, comprising:

an image carrier on which an electrostatic latent image is formed;

a developing device configured to supply developing agent to the image carrier;

a developing agent cartridge configured to supply developing agent and toner to the developing device, and include a cartridge main body, in which there is a first room and a second room and the boundary of the two rooms is closed by a closure member, configured to be filled with the toner and the developing agent into the first room and the second room, respectively;

a supply section supplying the infill in the second room to the developing device while stirring it; and an opening section opening the closure member to enable the toner to be moved to the second room after the developing agent filled into the second room is supplied to the developing device; and a transfer device configured to transfer the toner image formed on the image carrier by the developing device to a paper;

wherein the cartridge main body is provided with a toner filling port and a developing agent filling port configured to respectively fill the toner and the developing agent into the first and second rooms that are divided by the closure member.

4. A developing agent cartridge for supplying developing agent and toner to a developing device, comprising:

a cartridge main body, in which there is a first room and a second room and the boundary of the two rooms is closed by a closure member, configured to be filled with the toner and the developing agent into the first room and the second room, respectively;

a supply section configured to supply an infill in the second room to the developing device while stirring it;

an opening section configured to open the closure member to enable the toner to be moved to the second room after the developing agent filled into the second room is supplied to the developing device;

wherein the supply section includes a mixer configured to stir the infill in the second room in a rotatable manner, a screw configured to convey the stirred infill to the developing device, and a transmission mechanism configured to transmit the rotation force from the driving device to the screw and the mixer;

the opening section doesn't operate when the mixer rotates in a first direction, and is provided with a winding shaft configured to be interlocked to rotate when the mixer rotates in a direction opposite to the first direction; and when the toner is moved to the second room, the mixer is rotated in the reverse direction by the driving device to wind the closure member on the winding shaft.

* * * * *